US006415870B1

(12) United States Patent
Matsuoka

(10) Patent No.: US 6,415,870 B1
(45) Date of Patent: Jul. 9, 2002

(54) WET TYPE SPRINKLER SYSTEM

(76) Inventor: Gengo Matsuoka, 7-26-508 Yatsu 7-chome, Narashino-shi, Chiba-ken (JP)

( * ) Notice: Subject to any disclaimer, the term of this patent is extended or adjusted under 35 U.S.C. 154(b) by 0 days.

(21) Appl. No.: 09/446,873

(22) PCT Filed: Apr. 9, 1999

(86) PCT No.: PCT/JP99/01899

§ 371 (c)(1),
(2), (4) Date: Dec. 29, 1999

(87) PCT Pub. No.: WO00/61238

PCT Pub. Date: Oct. 19, 2000

(51) Int. Cl.[7] ..... A62C 35/00

(52) U.S. Cl. ..... 169/16; 169/20; 169/56; 169/60; 169/61; 239/208

(58) Field of Search ..... 169/13, 16–23, 169/56, 60, 61; 239/42, 208, 209

(56) References Cited

U.S. PATENT DOCUMENTS

| | | | | |
|---|---|---|---|---|
| 4,583,597 | A | 4/1986 | Spector et al. | |
| 5,947,207 | A | 9/1999 | Conforti et al. | |
| 6,209,654 | B1 * | 4/2001 | Curless | 169/17 |

FOREIGN PATENT DOCUMENTS

| | | |
|---|---|---|
| JP | 4295376 | 10/1992 |
| JP | 626292 | 7/1994 |
| JP | 712382 | 2/1995 |
| JP | 105366 | 1/1998 |
| JP | 10234881 | 9/1998 |
| JP | 114907 | 1/1999 |
| JP | 1176450 | 3/1999 |
| JP | 11146925 | 6/1999 |
| JP | 11206908 | 8/1999 |
| JP | 11262541 | 9/1999 |
| JP | 11276633 | 10/1999 |
| TW | 91108 | 4/1983 |
| TW | 82635 | 9/1984 |
| TW | 323519 | 1/1986 |

* cited by examiner

*Primary Examiner*—Lesley D. Morris
*Assistant Examiner*—Dinh Q. Nguyen
(74) *Attorney, Agent, or Firm*—Birch, Stewart, Kolasch & Birch, LLP

(57) ABSTRACT

The invention provides a wet-type sprinkler system by which the water damage caused when a sprinkler heads function in a wrong way with ensuring a quick extinguishing operation at the time of fire. A suction pipe is provided for the system so as to communicate with a top part of a secondary pipeline 24 of a feed pipe arrangement 20 forming a water supply line from a water supply unit 16 to sprinkler heads 12. Further, a suction unit (an electromagnetic valve 54 and a suction pump 50) for sucking the air in the secondary pipeline section 24 from the top part of the secondary pipeline section 24 is provided onto the suction pipe 52. The suction pipe 52, the suction pump 50 and the electromagnetic valve 54 constitute a negative-pressure-securing section. In the secondary pipeline 24, which is filled with water in a normal condition water is negatively pressurized by the suction operation of the suction unit. The negatively pressurized state of the water is ensured under a normal condition. Thus, water in the secondary pipeline is prevented from unnecessarily being discharged when the sprinkler heads 12 function in a wrong way.

6 Claims, 5 Drawing Sheets

WET TYPE SPRINKLER SYSTEM

FIELD OF THE INVENTION

This application is the national phase under 35 U.S.C. §371 of PACT International Application No. PACT/JAP99/01899 which has an International filing date of Apr. 9, 1999 which designated the united states of America.

This invention relates to an automatic extinguisher system for buildings, etc., and more particularly to a wet-type sprinkler system of which secondary pipelines are filled with water in a normal condition.

BACKGROUND ART

Hitherto, sprinkler systems are in widespread use in buildings, especially in large-scale buildings. In known sprinkler systems, sprinkler heads for fire-extinguish purpose are arranged on ceilings of buildings. The sprinkler system is composed essentially of the sprinkler heads each of which is individually actuated in response to an ambient thermal condition, a feed pump as a water supply unit, and a feed pipe arrangement including primary pipelines and secondary pipelines.

The primary pipeline(s) of the feed pipe arrangement is arranged in a manner perpendicularly rising from the feed pump, to reach the heights of floors. The secondary pipelines are connected to the primary pipeline such that water flows through the pipelines. The secondary pipeline(s) generally extends in the horizontal direction on each floor, and then it is branched and hung-down in the almost perpendicular direction to form hang-down pipe portions, which respectively communicate with the sprinkler heads.

The sprinkler systems with such structures as mentioned above are divided into wet-type sprinkler systems and dry-type sprinkler systems. These two types of the system are different in the following point: That is, in the former type, not only the primary pipelines but also the secondary pipelines are filled with water, and this state is called "normal condition". On the other hand, in the latter type, the secondary pipelines are not filled with water, i.e. They are filled with air (in other words, only the primary pipeline is filled with water).

In the known wet-type sprinkler system, water charged in the secondary pipelines in the same manner as in the primary pipeline is constantly kept pressurized, e.g. At 7 to 8 kg/cm$^2$. By this setting, the system has an advantage in that water discharge is quickly performed when the sprinkler head is actuated at the breaking out of fire. In general cases, however, the opening and shutting of the sprinkler heads are controlled not systematically but individually at the ceiling portions at which the sprinkler head are arranged. For example, when a sprinkler head is exposed to heat, a sealed portion thereof is melted, and the sprinkler head comes ready to jet water. Accordingly, in the event that the sprinkler head is actuated on an occasion other than an actual fire, for instance failure of the system or intentional destruction of the same, there is an inconvenience that pressurized water is instantly injected to drench the area around the sprinkler head. For example, when the sprinkler head functions in a wrong way in an office building, documents, computers, elevator systems, etc. Have incurred a huge amount of damage.

To cope with the inconvenience, a wet-type sprinkler system having an additional function of a so-called preliminary operation has been employed. The above-mentioned sprinkler system is provided with a valve section between the primary pipeline and each secondary pipeline. The valve section is caused to normally be closed, and the valve is opened by a control section of the system only when the control section receives a fire-detection signal from a fire sensor (which functions more quickly than the sprinkler head), followed by feeding a large volume of high-pressure water to the secondary pipelines as the preparation for actuating sprinkler heads.

This system only allows water in the secondary pipeline to be discharged in the event of wrong-way-function of the sprinkler heads, and therefore damage can be minimized compared with the prior system. However, the water in the secondary pipeline alone still causes a considerable amount of damage.

On the other hand, the dry-type sprinkler system has been developed to eliminate such damage. Namely, in this system, the secondary pipeline is filled with air which is pressurized at about 2 kg/cm$^2$, in place of water. Therefore, even if the sprinkler head undergoes a failure, only air is discharged, so that damage caused by water can be avoided. This is the largest advantage of the dry-type sprinkler system.

The dry-type sprinkler system requires a work of dewatering or draining the secondary pipe when water injection is carried out on trial. Even after the dewatering work, however, not a little volume of water remains in the hang-down pipe portions if each of the sprinkler heads is not actuated. As a result, it tends that the hang-down pipe portion in the vicinity of a boundary between water and air corrodes, and the corrosion once obtained easily spreads resulting in perforation. To eliminate the corrosion, periodical maintenance and repair are required, or a pipe formed of a special material becomes indispensable, and therefore the defrayal on a managing company is not small.

Further, there is such a tendency that a very small volume of air leaks at a junction of the pipelines, etc., compared with the case where water is stored, so that decrease in pressure of air is relatively fast, which requires frequent addition of air into the secondary pipelines by means of a compressor or the like. The supplement of air, however, disadvantageously brings about supply of oxygen, thereby promoting the formation of rust.

Still further, when water injection for actually extinguishing fire is carried out, water pressurized at about 7 to 10 kg/cm$^2$ flows from the feed pump into the secondary pipelines upon opening of the valve section. If air remains at the corners or upper portions in the pipeline, however, an effective cross section of flowing water in the pipeline is reduced, which can unfavorably prevent water from flowing.

Even further, when water highly pressurized by the feed pump is supplied to the sprinkler heads which have not yet been actuated, air stored therein beforehand is compressed to become high pressure air, thereby causing such a danger that elastic force of the high pressure air can blow off components of the sprinkler heads. In addition, when a fire actually breaks out, water cannot be discharged until the charged air is completely drawn off. As a result, it is pointed out that the dry-type sprinkler system is inferior to the wet-type sprinkler system in immediacy at an initial extinguishing operation which is the essential object of sprinkler systems.

To cope with the various inconveniences of the known sprinkler systems, particularly to enhance a rust prevention performance, an extinguishing fixture is proposed, for example, in Japanese Patent Kokai Publication Hie 10(1998)-234881. According to the extinguishing fixture, in place of air, inert gas is charged in a pipe portion of the secondary pipeline, at a location immediately above the sprinkler heads of the wet-type sprinkler system. By using inert gas such as nitrogen gas, rusting and development thereof can be effectively prevented in both the wet-type sprinkler system and the dry-type sprinkler system.

Further, there is disclosed a water flow detecting system for a wet-type sprinkler system, for example, in Japanese Patent Kokomo Publication No. Hie 7(1995)-12382, in which fluid in the secondary pipelines is brought to have a low pressure (but not negatively pressurized) than water in the primary pipelines. In this case, if a fire actually breaks out, the low-pressure water in the secondary pipelines is immediately discharged, so that it is considered that this system is effective for initial extinguishing operation.

However, in the above mentioned extinguishing fixture disclosed in Japanese Patent Kokai Application Hie 10(1998)-234881, in which inert gas has been charged, if the sprinkler head is actuated in a relatively small and tightly closed room, nitrogen gas fills the room, whereby the room undergoes oxygen deficiency, which can adversely affect safety.

Further, according to the invention disclosed by Japanese Patent Kokomo Publication No. Hie 7(1995)-12382, the immediacy of the initial extinguishing operation can be ensured. However, water is pressurized although the pressure degree is low. Therefore, damage caused by water injection is not avoidable when sprinkler heads function in a wrong way.

The present invention is proposed to eliminate the above inconveniences, and an object of the invention is to provide a wet-type sprinkler system which is capable of preventing damage to be caused by water when a sprinkler head functions in a wrong way, with ensuring to quickly perform an initial extinguishing operation of sprinkler heads at an actual fire.

DISCLOSURE OF THE INVENTION

To attain the above mentioned object, a wet-type sprinkler system according to claim 1 of the present invention has a negative-pressure-securing unit for maintaining water charged in at least one secondary pipeline of a feed pipe arrangement in a negatively pressurized. This negatively pressurized state is considered as a normal condition, namely "ready state", in the present invention.

As a result, even if sprinkler heads which are individually actuated in a wrong way to given an open state, water in the secondary pipeline can be prevented from being erroneously discharged, from the sprinkler heads. In other words, water in the secondary pipeline is maintained in the negatively pressurized state, so that air may be drawn into the opened sprinkler heads but water can never be injected from the sprinkler heads.

When a fire actually breaks out, a control section receives a fire-detection signal from a fire sensor, and causes a valve section to be opened and a water supply unit to start operation. Thus, water is conveyed from at least one primary pipeline to the secondary pipeline, whereby the pressure in the secondary pipeline is changed from the negatively pressurized state to a positively pressurized state. The system in such a preparatory movement (by the attainment of the valve opening) jets water through sprinkler heads by means of individual opening movements thereof.

In a wet-type sprinkler system as claimed in claim 2, there are provided a suction pipe communicating with the secondary pipeline of the feed pipe arrangement at a top part thereof, the secondary pipeline forming a water supply line from the water supply unit to the sprinkler heads, and a suction unit for sucking the internal part of the secondary pipelines which is provided at a top part of the secondary pipelines, the suction pipe and the suction unit forming the negative-pressure-securing unit. The water stored in the secondary pipeline which is normally filled with water is negatively pressurized due to the suction operation of the suction unit, and the negatively pressurized state is considered as a normal condition.

As a result, the negative-pressure-securing unit with a simple structure surely functions.

A wet-type sprinkler system as claimed in claim 3 comprises a water level detecting unit arranged at a top part of the secondary pipeline for detecting a water level in the secondary pipeline, wherein the control section controls the water supply unit and the opening and shutting of the valve section when the water level becomes lower than a predetermined level in response to a signal supplied from the water level detecting unit, to supply water from the primary pipeline to the secondary pipeline section.

By virtue of this construction in addition to the function as claimed in claim 1, the level of water in the secondary pipeline, which is negatively pressurized and accordingly likely to evaporate, can always be kept, whereby immediacy of the fire extinguishing system can be maintained.

Subsequently, the a wet-type sprinkler system as claimed in claim 4 has such a function that the control section controls the valve section so as to be opened only when the control section receives the fire-detection signal a plurality of times within a predetermined time period.

By virtue of this structure, in addition to the function as claimed in claim 1, it becomes possible to effectively prevent the secondary pipeline from being unnecessary relieved from the negatively pressurized state then to be positively pressurized by a mere wrong-way-function of the fire detecting unit.

According to a wet-type sprinkler system as claimed in claim 5, the suction pipe of the negative-pressure-securing unit is provided with a negative-pressure-regulating member for canceling excessive negative pressure of water caused by the suction operation of the suction unit. As a result, the pressure of water can be increased before the sucked water is brought to have an excessively negative pressure and accordingly evaporates to cause cavitation.

In a wet-type sprinkler system as claimed in claim 6, the negative-pressure-regulating member in claim 5 are implemented as a vacuum breaking valve which functions to increase the pressure of water, when the negative pressure becomes lower than a predetermined value. The vacuum-breaking valve has a single function for which troublesome setting is not necessary, whereby the negative pressure regulation can be achieved with a minimum cost without fail.

BEST MODE FOR CARRYING OUT THE INVENTION

Figure 1:
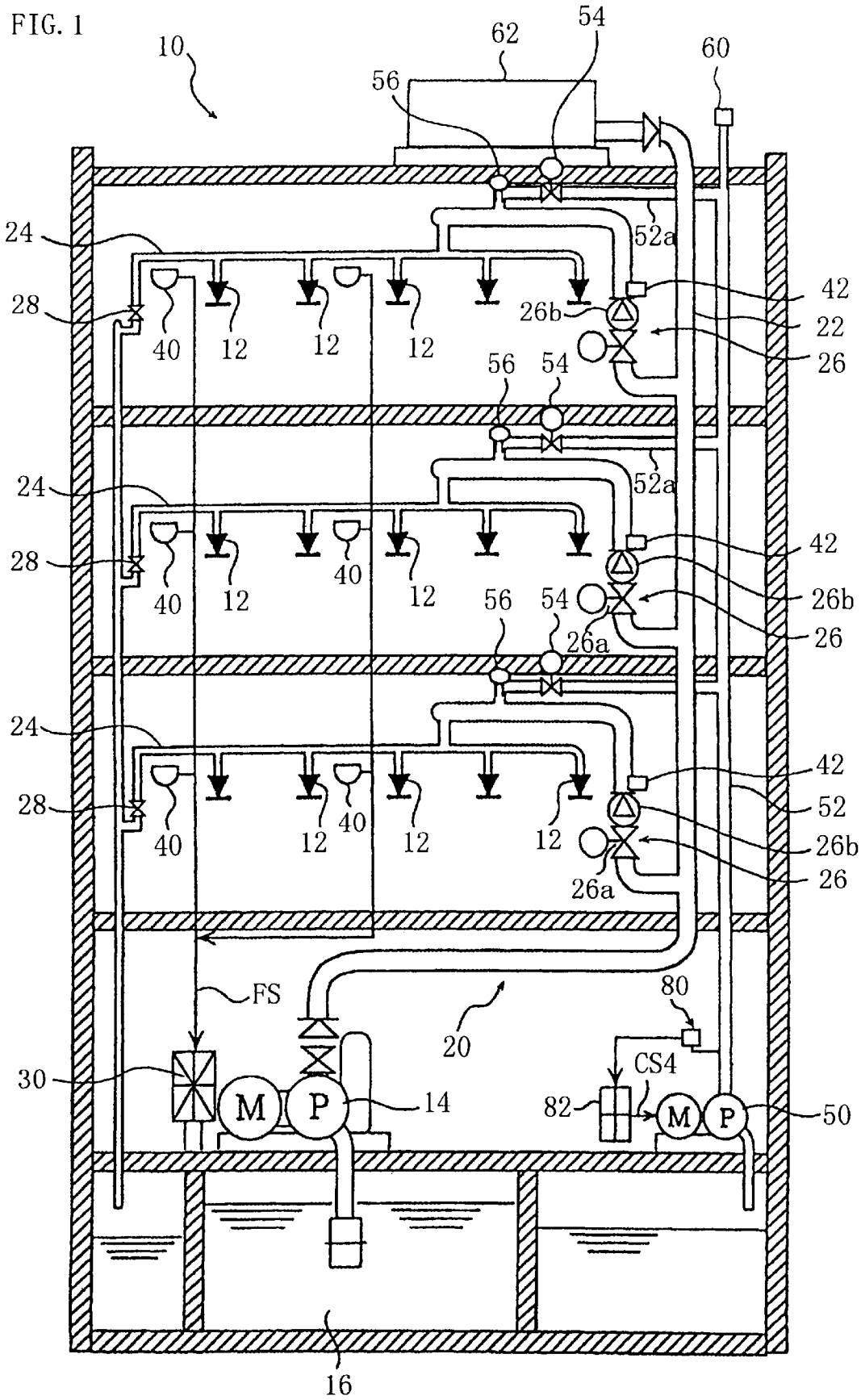
FIG. 1 is a schematic diagram for showing the outline of a wet-type sprinkler system according to a first embodiment of the invention.

The invention will now be described in detail with referring to embodiments thereof. FIG. 1 shows the outline of a wet-type sprinkler system 10 as a first embodiment of the invention. As shown in the figure, the wet-type sprinkler system 10 is essentially composed of a fire extinguishing water tank 16, a feed pump 14, a feed pipe arrangement 20, and sprinkler heads 12.

The fire extinguishing water tank 16 is located at an undermost portion of a building, for instance, at a basement, which stores a sufficient volume of water by that water discharge can be carried out over a long time period from a number of sprinkler heads 12 on each floor of the building. The feed pump 14 functions as a water supply unit, and is selected from those which can continuously discharge water in an amount of 80 liters or more per main simultaneously from each of the 8 to 40 sprinkler heads even under water-flow resistance when transmitted to the pipe arrangement.

The feed pipe arrangement 20 is composed of a primary pipeline(s) 22, valve sections 26, and secondary pipelines 24, and forms a water supply line from the feed pump 14 to the sprinkler heads 12. The primary pipeline 22 is formed as a feed pipe which is raised in an approximately perpendicular direction from the feed pump 14 to an uppermost floor of the building or the like and branched off on each floor. The diameter of the pipes forming the primary pipeline is selected to be large so as to meet a huge volume of water discharge from the feed pump 14.

Figure 2:
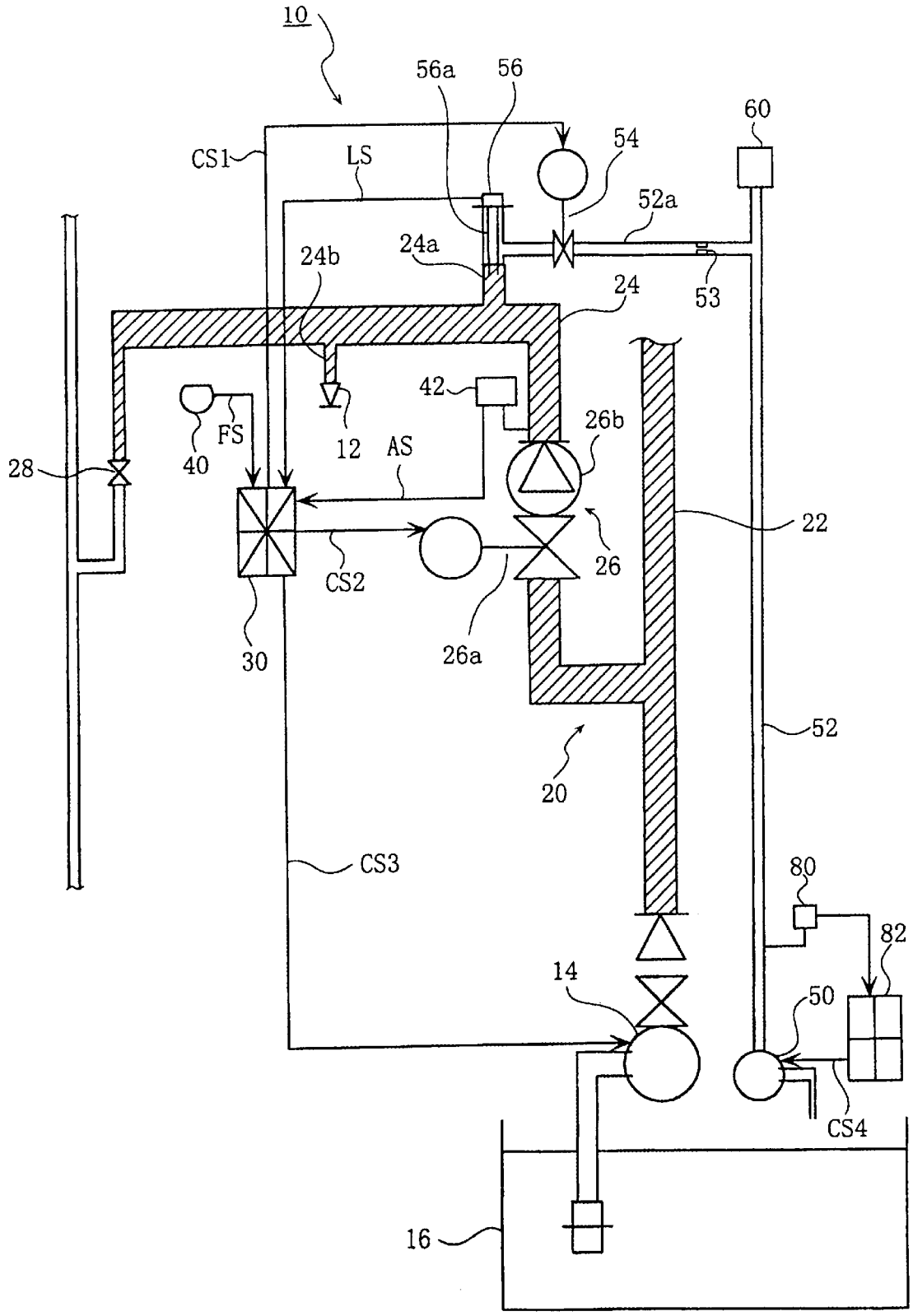
FIG. 2 is a block diagram showing the essential components of the wet-type sprinkler system of FIG. 1.

FIG. 2 is a block diagram for showing the construction of the essential parts of the wet-type sprinkler system 10 of FIG. 1. As shown in the figure, the valve section 26 is connected to an upper end portion of the primary pipeline 22 which is branched off on each floor, at the feed pump side as water pass therethrough. The valve section 26 is composed of an electric valve 26*a* and an alarm valve 26*b*. The electric valve 26*a* is kept closed in a normal condition, which will be described hereinafter relating to it's function. The alarm valve 26*b* has a function of giving an alarm when the electric valve 26*a* is opened and at the same time water discharge are carried out over a predetermined time period.

The secondary pipeline 24 has one end connected to the valve section 26, giving communication therebetween, and extends in parallel with the other secondary pipelines of other floors. Then, the secondary pipeline 24 is further branched off, and each of the branched portions hangs down in the perpendicular direction, thereby forming a hang-down pipe portion 24*b*. The hang-down pipe portion 24*b* has an end thereof to which is attached the sprinkler head 12 exposed from a ceiling portion on each floor. The secondary pipeline 24 does not need to be so large in diameter as the primary pipeline 22, and a pipe forming the secondary pipeline can be freely selected from those which are sufficient, in diameter, material and thickness, to resist a predetermined pressure condition, which will be hereinafter described. There is provided a test valve 28 on the secondary pipeline 24 at a lower end thereof, which is opened for discharging water on trial or for initially introducing water into the pipelines.

The sprinkler head 12 has a large number of injection holes (not shown) formed in an end surface thereof. The injection holes are normally closed, whereas the sprinkler head 12 individually has a function of opening the injection holes to jet water or the like when ambient temperature rises to a predetermined high value, e.g. To 80° C. To open the injection holes, a high-temperature softening property of a metal having a low melting point is employed in general, but any other structure or component is applicable insofar as the above-mentioned function can be achieved. The sprinkler heads 12 having the function as mentioned above are respectively connected to the distal ends branched from the secondary pipeline 24 of the feed pipe arrangement 20.

In addition to the above described structure, the wet-type sprinkler system 10 of this embodiment is provided with a fire sensor 40 and a control panel 30, both of which achieve a preparatory movement, and further includes "suction unit" and "water level detecting unit" arranged in the secondary pipeline 24 as characteristic points.

The fire sensor 40, as a fire-state detection unit, is provided on each floor. The sensor 40 has a function of detecting smoke, flames, and ambient temperature with a high sensitivity and at a high speed, thereby supplying a fire-detection signal AS to the control panel 30 when the ambient temperature reaches a predetermined high temperature. The fire sensor 40 is selected from those which can detect the ambient temperature etc. More quickly than the sprinkler heads 12.

The control panel 30 functions as a control section of the system. The control panel 30 has an input block which can receive various signals from the outside, a determining block composed of a memory, a relay circuit, etc. Which are operated according to a preset control theory, and an output block which generates control signals to each of the valves and the feed pump 14 and supplies power to the same. With this structure, the control panel 30 carries out determination, based on the fire-detection signal AS transmitted from the fire sensor 40, thereby controlling the opening degree, open/closed states, etc. Of each valve.

As understood from FIG. 1 as well, the "suction unit" as a characteristic structure of the present invention is composed of a suction pump 50, a suction pipe 52, and a drawing electromagnetic valve 54 in this embodiment. More specifically, the suction unit is composed of the suction pipe 52 of which one end communicates with a raised branch pipe 24*a* of the secondary pipeline 24, as formed being raised from the uppermost portion of the secondary pipeline 24, extends to an approximately horizontal direction, and further extends in a hang-down manner over a predetermined length; the drawing electromagnetic valve 54 arranged across the roughly horizontal portion of the suction pipe 52; and the suction pump 50 arranged at a lower end of the suction pipe 52.

The suction pump 50 may be of any type insofar as it is arranged at a lower location of the building wherein the suction pump 50 absorbs liquid such as water or gas such as air, and has capacity sufficient to maintain the secondary pipeline 24 on each floor to have a predetermined negative pressure of water. The drawing electromagnetic valve 54 is controlled to be opened and closed in response to the control signal from the output block of the control panel 30.

Further, in the "water level detecting unit", with a characteristic structure, of the present invention, a water level detector 56 having two electrodes 56*a* is arranged in the raised branch pipe 24*a* in this embodiment by way of an example. In the water level detector 56, a predetermined electric potential is given to the electrodes 56*a*, and an energized state across the electrodes 56*a* is detected in a binary form, followed by supplying the signal indicative of the detected binary value to the control panel 30. More specifically, when the ends of the two electrodes 56*a* are in contact with water, an energized state are obtained by the two electrodes, whereas when the ends are separated from water, the energized state are not obtained. Accordingly, the detector 56 detects the change of the energized state and non-energized state as a change of a water level within the secondary pipeline 24, and outputs the change as a binary signal.

Further, as shown in FIGS. 1 and 2, the wet-type sprinkler system 10 is provided with a pressure switch 42 for detecting fluctuations of the pressure within the secondary pipeline 24.

Figure 3:
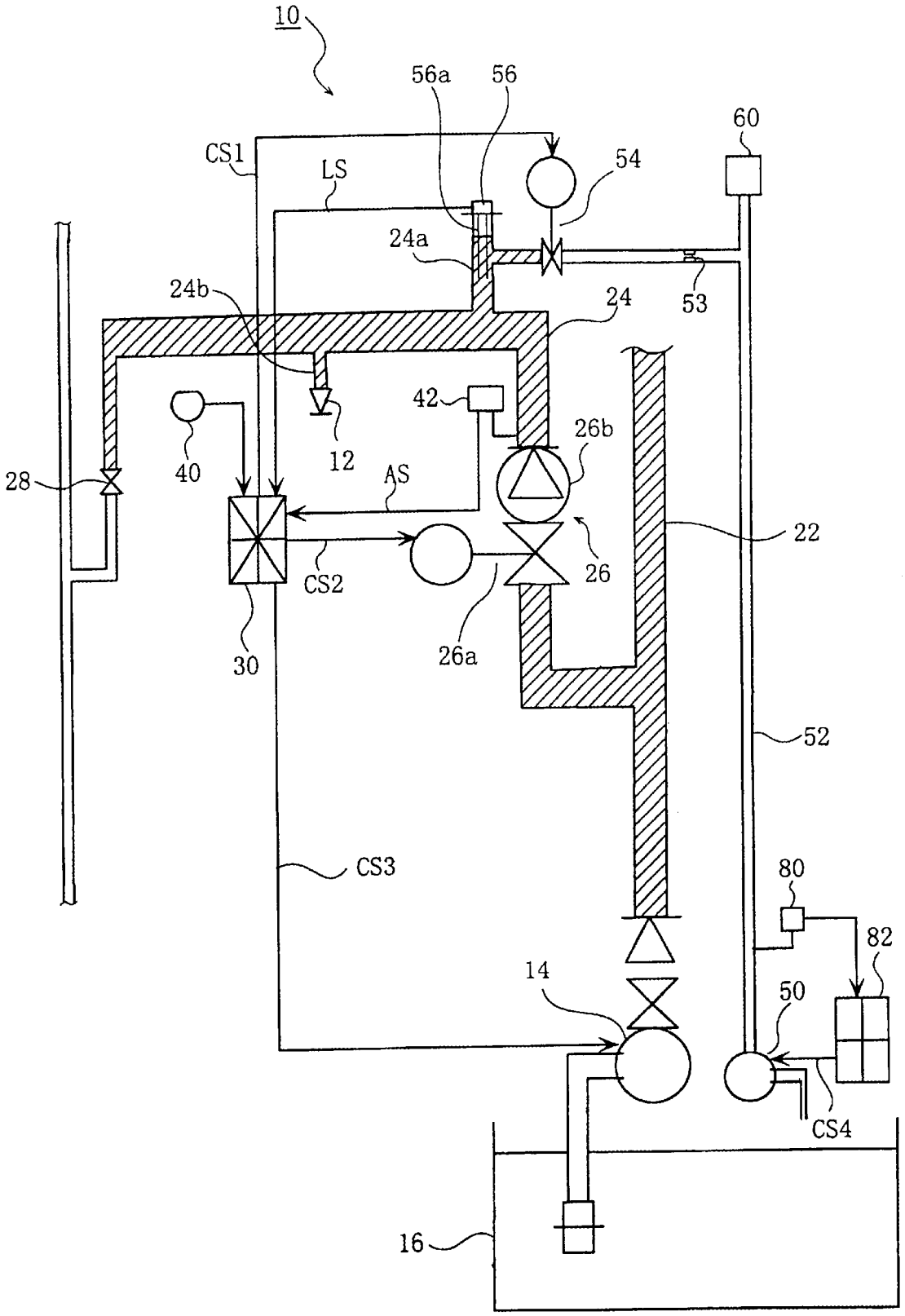
FIG. 3 is a diagram for showing a state of the wet-type sprinkler system of FIG. 2, when a fire has broken out.

Description will now be made as to the function of the system as an embodiment, which has the above-described structure. FIG. 3 shows a state of the wet-type sprinkler system 10 of FIG. 2 in the case where a fire has actually broken out.

First of all, the feed pipe arrangement 20 is filled with water in an initial state. The operator of the system opens each of the valves except the drawing electromagnetic valve 54, and causes the feed pump 14 to drive, whereby water is conveyed from the fire extinguishing water tank 16 into the feed pipe arrangement 20 to fill the same. Then, the electric valves 26*a* and the test valves 28 are closed to halt the operation of the feed pump 14. Thus, the primary pipelines 22 and the secondary pipelines 24 are filled with water at a high pressure for instance, of 8 kg/cm$^2$.

Then, the operator opens the drawing electromagnetic valve 54, and causes the suction pump 50 to be driven, whereby the internal gas of the suction pipe 52 and the secondary pipelines 24 are sucked. At this time, all of the end portions are closed, except those of the raised branch pipes 24*a* which form the uppermost portions of the secondary pipelines 24. Therefore, water stored in the secondary pipelines 24 is not affected by back pressure of the atmospheric air, and kept at a pressure lower than the atmospheric pressure according to a suction force of the suction pump 50 and therefore in a negatively pressurized state, by which water remains in the secondary pipeline 24.

The above-mentioned suction operation by the suction pump 50 is carried out even if the water level in the raised branch pipe 24*a* is lower than a location of an opening of a horizontal part 52*a* of the suction pipe having the drawing electromagnetic valve 54 as shown in FIG. 2. Water in the secondary pipelines 24 can be negatively pressurized by the suction operation by means of the suction pump 50.

After obtaining a negative pressure, the operator observes the state of a signal from the water level detector 56. Having confirmed that the water level is in the vicinity of the electrodes 56*a*, i.e. Water is maintained to have the level which is sufficient to generate the energized state, the operator stops the drive of the suction pump 50. Then, the drawing electromagnetic valve 54 is kept open, thereafter the suction pump 50 is automatically operated and controlled by means of a vacuum switch 80 arranged on the suction pipe 52, so as to maintain a predetermined negative pressure of, e.g. −0.4 kg/cm$^2$ to −0.5 kg/cm$^2$. More specifically, a pump control block 82 supplies a control signal CSF for controlling the drive of the suction pump 50 in response to a signal from the vacuum switch 80. These sequential operations form the initial state, and then the system is transferred to a fire monitoring state.

In this manner, the secondary pipeline 24 is sufficiently filled with negative pressure water, so that the rust preventive performance therein is enhanced. As a result, perforation etc. Caused by rusting can be prevented, which frequently occurs in known systems at the hang-down pipes 24*b* at parts in contact with the air.

The water negatively pressurized within the secondary pipeline 24 has a lowered boiling point, which leads to quick evaporation, and therefore the volume of water is easily reduced and the water level is likely to drop. To cope with this, if the control panel 30 receives a signal SL indicative of water level drop (non-energized state) from the water level detector 56, it outputs a control signal CDs from its output block to the valve section 26, whereby water is added by slightly opening the electric valve 26*a*. As a result, the water is always maintained to have the same level as that of the initial state. By maintaining the water level to the highest, the instantaneous operability of the fire extinguishing system is ensured. In regard to this, the addition of pressurized water to the primary pipeline 22 is carried out by supplying water from an auxiliary water tank 62 placed on a roof portion in place of the drive of the feed pump 14.

In the fire monitoring state, the fire sensors 40 each monitor whether or not a fire has broken out, at respective predetermined locations on each floor. In case of a fire occurring at one of the locations, the fire sensor 40 senses a fire state, and supplies the fire-detection signal AS to the control panel 30.

The control panel 30 which has received the fire-detection signal AS by way of the input block, supplies the control signal CDs by way of the output block for driving the electric valve 26*a* on the floor of the fire sensor 40 which has sensed the fire state. Thus, the electric valve 26*a* is opened. Further, the control panel 30 supplies a control signal CSF to the drawing electromagnetic valve 54 simultaneously with the output of the signal CDs. Upon the receipt of the signal, the drawing electromagnetic valve 54 is closed, whereby it is separated from the suction unit on the secondary side. Simultaneously, the control panel 30 supplies a control signal CSF to the feed pump 14 for activating the same, whereby the feed pump 14 is driven.

As shown in FIG. 3, a preparatory movement is carried out wherein a large volume of pressurized water stored in the primary pipeline 22 flows into the secondary pipeline 24 on the floor on which the fire has broken out, and therefore the water which has been negatively pressurized in the secondary pipeline 24 is brought to have a highly pressurized state of the level of, e.g. 6 kg/cm$^2$.

Subsequently, when one of the sprinkler heads 12 is actuated due to exposure to heat caused by a fire at the initial stage, the high-pressure water in the secondary pipeline 24 is instantly injected from the sprinkler head 12 to start an extinguishing operation.

By the injection of the water from the sprinkler head 12, the sprinkler system is in a water-running state in which water is continuously supplied from the primary pipeline(s) 20 to the secondary pipeline(s) 24. The above sequential operations cause the sprinkler head 12 to continuously inject a large volume of water.

The continuous water discharge eliminates a possibility of injecting compressed air, and therefore inconveniences such as scattering of the components of the sprinkler head 12 can be dispensed with, which could occur if high-pressure air was jetted.

Then, the person who takes care of the system confirms that the extinguishing operation by the sprinkler has been completed, and closes the electric valve(s) 26*a*, followed by halting the feed pump 14. Thereafter, the sprinkler head 12 which has been operated is replaced by a new one, then every part of the system is examined, and finally the system is reset to the initial state.

Figure 4:
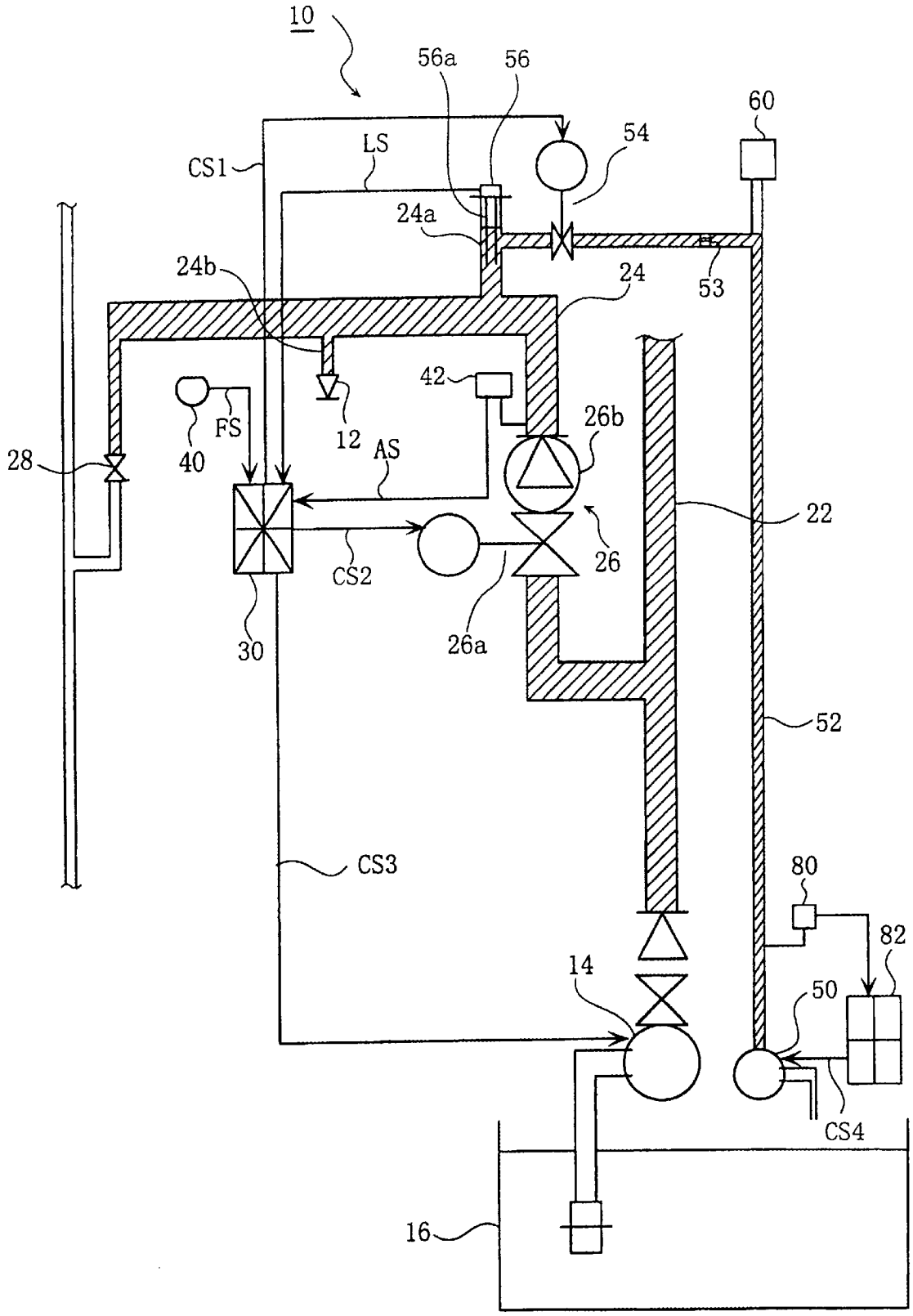
FIG. 4 is a diagram for showing a state of the wet-type sprinkler system of FIG. 2, when a sprinkler head of the wet-type sprinkler system functioned in a wrong way.

FIG. 4 is a descriptive drawing showing a state in which the sprinkler head 12 of the wet-type sprinkler system 10 of FIG. 2 functions in a wrong way. In the fire monitoring state, when the sprinkler head 12 is damaged or functions in a wrong way, the wet-type sprinkler system 10 of this embodiment works in the following manner. In this state, the fire-detection signal AS is not output from the fire sensor 40.

Due to the wrong-way-function of the sprinkler head 12, the water-injection holes on the end surface of the sprinkler head 12 are opened, and the secondary pipeline 24 is opened to the air. The system of the present invention, however, maintains water in the secondary pipeline 24 with a negative pressure.

Accordingly, water is not come out from the sprinkler head 12, whereby damage by water is not caused by the wrong-way-function of the sprinkler head 12. Further, as shown in FIG. 4, water stored in the secondary pipeline 24 is exposed to the atmospheric pressure through the water-injection holes of the sprinkler head 12 and the water moves toward the suction pipe 52 which is kept at the negative pressure by the suction force. Namely, water in the secondary pipeline 24 passes through the drawing electromagnetic valve 54 which has been opened beforehand, and is drawn toward the suction pump 50.

The pressure switch 42 detects fluctuations of pressure within the secondary pipeline 24 occurring at this water drawing. Then, the pressure switch 42 outputs a signal AS indicative of occurrence of the wrong-way-function to the control panel 30. The person who takes care of the system confirms this state by observing the control panel 30, and then examines the sprinkler head 12 and exchanges the one which is out of order for a normal one. Therefore, damage by unnecessary water jet is not caused, and the system can be reset to the initial state after the examination of components. In this embodiment, in order to make fluctuations of pressure more distinctive within the secondary pipeline 24 caused by the wrong-way-function, an orifice 53 is provided on the horizontal part 52*a* of the suction pipe in addition to the drawing electromagnetic valve 54.

Further description will be made on another embodiment, in which the sprinkler system additionally contains a system for avoiding damage due to a failure of the fire sensor 40. The control panel 30 has a timer provided therefore, in addition to the above-described components. The timer starts to count a predetermined time period upon the receipt of an activation signal, and outputs a time-lapse signal after the lapse of the predetermined time period.

In the fire monitoring state, the control panel 30 with the timer does not immediately output the control signal CS, but generates the activation signal to the timer when receives the fire-detection signal AS from the fire sensor 40 by way of the input block. Upon the receipt of the activation signal, the timer starts counting of the predetermined time period which is set, for instance, as 2 min.

If the fire-detection signal is supplied again from the fire sensor 40 before the time lapse signal is generated by the timer to notify 2 minutes lapse, the control panel 30 outputs the control signals CS1, CD2, and CS3 by way of the output block to instantly carry out the above described operations of the electric valve 26*a*, the drawing electromagnetic valve 54, and the feed pump 14. Thus, the initial extinguishing operation can be promptly carried out in the same manner as in the first embodiment.

The control panel 30 returns to the initial monitoring state according to a logic set beforehand, if the fire-detection signal is not sent from the fire sensor 40 but the time lapse signal is output from the timer after the output of the activation signal. In this case, it is determined as that the fire-detection signal from the fire sensor 40 was generated due to a wrong-way-function thereof.

By virtue of this logical formation, even if the fire sensor 40 functions in a wrong-way, due to smoke of cigarette, flames of a lighter, or the like, the wet-type sprinkler system 10 does not carry out the preparatory movement, i.e. To close the drawing electromagnetic valve 54 and to switch the secondary pipeline 24 on each floor to the pressurized state. Therefore, it became possible to appropriately activate the system responsive to more accurate fire detection. The person who takes care of the known system sometimes stops the whole system since it is annoying for the person that the system often functions in a wrong way. This sort of risk can be eliminated before some incident happens when the system of the invention is employed.

Description will now be made on a further embodiment of the invention with reference to FIG. 1. The wet-type sprinkler system 10 of this embodiment has a negative-pressure-regulating member arranged at a predetermined location of the suction pipe 52, for regulating pressure within the suction pipe 52 by relieving the interior of the suction pipe 52 according to the degree of the negative pressure therein.

In this embodiment, the system has a vacuum-breaking valve 60 as the pressure-regulating unit at a top end location of the suction pipe 52. The vacuum-breaking valve 60 has a sole function to set to give a single degree of vacuum. The vacuum breaking valve 60, however, has such advantages that the setting is easy, it is inexpensive and it surely functions. The vacuum-breaking valve 60 has one end thereof connected to the suction pipe 52 and the other end thereof is opened to the air.

As the negative pressure of water is increased, the boiling point falls owing to the relationship between the negative pressure and the saturated vapor pressure. Accordingly, water can boil and evaporate depending on the pressure and the ambient temperature. For example, in a medium-scale or large-scale building, the location of the secondary pipeline 24 on the top floor is at an altitude of 10 m or more, and accordingly the length of the suction pipe 52 is over 10 m. When negative pressure water is moved toward the suction pump 50 at the time of a wrong-way-function of the sprinkler head 12, the vacuum degree in the suction pipe 52 is excessively increased, and water can boil at room temperature. The thus emerging phenomenon can cause cavitation, and it is known that when cavity which is formed by air bubbles is quenched, intensive impulse waves are generated, whereby the pipelines and the pumps can be gradually broken down.

To prevent this phenomenon, the vacuum-breaking valve 60 is promptly actuated when a predetermined negative pressure is reached, and then air from the atmosphere is introduced into the suction pipe 52. By this introduction, the phenomenon of cavitation can be prevented beforehand, thereby avoiding the damage of the suction pipe 52 and the suction pump 50 in the medium-scale or large-scale building.

Figure 5:
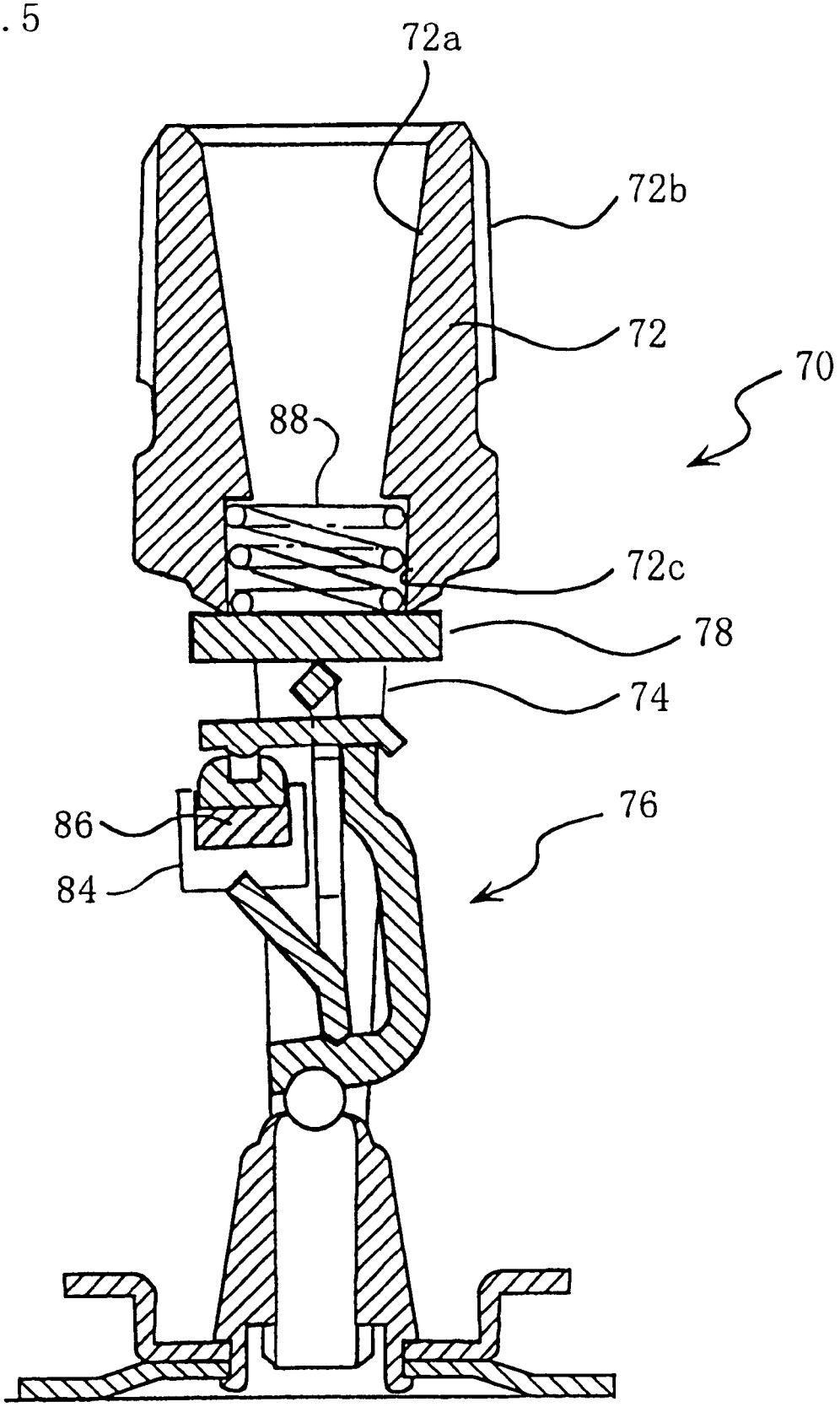
FIG. 5 is a descriptive drawing for showing an example of the structure of the sprinkler head applicable to the system of the invention.

FIG. 5 shows the construction of a sprinkler head suitable to the wet-type sprinkler system described in each of the above embodiments of the invention. The sprinkler head 70 includes a fixing portion 72 for fixing the sprinkler head onto the ceiling portion. The fixing portion 72 has its interior provided with a water channel 72*a* and its peripheral surface provided with a male screw portion 72*b* for fixing the sprinkler head 70. Further, the fixing portion 72 has its lower portion provided with a holding frame 74 which is formed as a ring in order to hold a sealing portion (referred to hereinafter). The fixing portion 72 and the holding frame 74 are integrally formed.

The fixing portion 72 has an opening portion 72*c* for scattering water, formed at a lower end thereof, which is sealed by a sealing portion 76 held in the sealing frame 74 in a normal condition. The sealing portion 76 has a sealing plate 78 for closing the opening portion 72*c*, and a movable holding portion 84, which is equipped with an alloy 86 having a low melting point and functions to remove the sealing plate 78 at the time of fire broken out and to maintain a closed state of the same at a time other than fire. The structure and function of the movable holding portion 84 are the same as those in known ordinary sprinkler heads.

The structure of the sprinkler head 1 of this embodiment is characterized in that the sprinkler head is provided with an urging member on the side of the fixing portion 72, for urging the sealing plate 78 in the direction of separating the sealing plate 78 from the fixing portion 72. In this embodiment, a spring 88 is mounted inside the fixing portion 72 and always pressing the sealing plate 78 from the inside of the fixing portion 72 in the direction of pressing and separating the sealing plate 78. Therefore, when the alloy 86 having a low melting point is melted and hence the movable holding portion 84 is actuated to remove the support of the sealing plate 78, the sealing plate 78 can surely be removed. The setting of the urging member is not limited to mounting the spring 88 within the fixing portion 72. Alternatively, the urging member may be set outside the fixing portion 72, between the fixing portion 72 and the sealing plate 78. Further, a plate spring is applicable.

In the wet-type sprinkler system according to the invention, water within the fixing portion is changed to the state wherein the pressure shows a positive value when a fire has broken out. However, when the head is opened with storing negative pressure water therein at an actual fire, the opening operation can be carried out in a more prompt and ensured manner. Namely, the sealing plate 78 is removed without fail, by a urging force of the spring 88, which is stronger than a suction force of the sealing plate 78 caused by the negative pressure water.

The present invention is not limited to the constructions of the respective embodiments described above, but various modifications may be made within the scope of the subject matter of the invention. Especially, a negative-pressure-securing unit for achieving and maintaining the negative pressure of water within the secondary pipelines, which forms the essential characteristic of the invention, is not limited to the structure described in the above embodiments. Alternatively, any other structures are also applicable so long as the negative pressure is maintained.

Further, in addition to the negative-pressure-regulating member, the system may include additional negative pressure regulating member at any part of the secondary pipelines 24. In this case, it is possible, by the initial setting of the system, to prevent water from being brought to have an excessively negatively pressurized state at room temperature, hence from boiling and evaporating.

In the above embodiments, the control panel 30 automatically controls the electric valve 26*a* such that high-pressure water in the primary pipeline 22 is conveyed to the secondary pipelines 24 as the preparatory movement for making preparations for the actuation of the sprinkler heads 12, upon the receipt of the fire-detection signal transmitted by the fire sensor 40. Alternatively, the person who takes care of the system or the like may manually open the electric valve 26*a*, based on a warning sound from the fire sensor 40 or the display of the fire-detection signal, or the like.

EFFECT OF THE INVENTION

By use of a wet-type sprinkler system of the invention, water injection is speedily carried out without injecting high-pressure air from sprinkler heads when a fire breaks out as described above. Accordingly a safe and positive initial extinguishing operation can be performed. Furthermore, even if the sprinkler heads function in a wrong way, unnecessary water injection is not carried out, so that it is possible to avoid damage with water. Thus, the sprinkler system of the invention exactly performs fire-extinguishing operation only at actual fire.

What is claimed is:

1. A wet-type sprinkler system comprising:

sprinkler heads for being individually actuated;

a water supply unit for supplying water to said sprinkler heads;

a feed pipe arrangement having at least one primary pipeline connected to said water supply unit, at least one secondary pipeline connected to said sprinkler heads, and a valve section which is closed in a normal condition to interrupt communication between said primary pipeline and said secondary pipeline, said feed pipe arrangement forming a water supply line from said water supply unit to said sprinkler heads;

a fire detecting unit for outputting a fire-detection signal in response to detection of a fire state;

a control section for controlling said water supply unit and the opening and shutting of said valve section in response to said fire-detection signal;

said primary pipeline and said secondary pipeline of said feed pipe arrangement both being filled with water under a normal condition;

a negative-pressure-securing unit for causing to maintain water in said secondary pipeline in a negatively pressurized state; and said negatively pressurized state of water is ensured under a normal condition.

2. The wet-type sprinkler system as claimed in claim 1, wherein said negative-pressure-securing unit comprises a suction pipe communicating with said secondary pipeline provided at a top part thereof, and suction unit on said suction pipe, for sucking the air in said secondary pipeline from the top part of said secondary pipeline, water in said secondary pipeline being negatively pressurized due to a suction operation of said suction unit.

3. The wet-type sprinkler system as claimed in claim 2, wherein said suction pipe of said negative-pressure-securing unit is provided with a negative-pressure-regulating member for canceling an excessively negatively pressurized state of water caused by the suction of said suction unit.

4. The wet-type sprinkler system as claimed in claim 3, wherein said negative-pressure-regulating member is prepared as a vacuum breaking valve which is operated when the negatively pressurized state of water becomes lower than a predetermined level to increase water pressure.

5. The wet-type sprinkler system as claimed in claim 1, further comprising a water level detecting unit at a top part of said secondary pipeline for detecting water level in said secondary pipeline, said control section controlling said water supply unit and the opening and shutting of said valve section when the water level becomes lower than a predetermined level, in response to a signal supplied from said water level detecting unit to supply water from said primary pipeline to said secondary pipeline until said water level exceeds said predetermined level.

6. The wet-type sprinkler system as claimed in claim 1, wherein said control section causes said valve section to be opened only when said control section receives said fire-detection signal a plural number of times within a predetermined time period.

* * * * *